US009682408B2

(12) United States Patent
Thompson

(10) Patent No.: US 9,682,408 B2
(45) Date of Patent: Jun. 20, 2017

(54) CLEANING TOOL DEVICE

(71) Applicant: Amy Thompson, Amenia, NY (US)

(72) Inventor: Amy Thompson, Amenia, NY (US)

( * ) Notice: Subject to any disclaimer, the term of this patent is extended or adjusted under 35 U.S.C. 154(b) by 375 days.

(21) Appl. No.: 14/272,201

(22) Filed: May 7, 2014

(65) Prior Publication Data

US 2014/0332029 A1 Nov. 13, 2014

Related U.S. Application Data

(60) Provisional application No. 61/821,190, filed on May 8, 2013.

(51) Int. Cl.

| | |
|---|---|
| ***B08B 1/00*** | (2006.01) |
| ***A47L 13/46*** | (2006.01) |
| ***B25G 1/04*** | (2006.01) |
| ***A46B 5/02*** | (2006.01) |
| ***A46B 5/00*** | (2006.01) |
| *B25G 1/06* | (2006.01) |

(52) U.S. Cl.

CPC ..... *B08B 1/006* (2013.01); *A46B 5/002* (2013.01); *A46B 5/021* (2013.01); *A47L 13/46* (2013.01); *B08B 1/00* (2013.01); *B08B 1/002* (2013.01); *B08B 1/008* (2013.01); *B25G 1/04* (2013.01); *B25G 1/06* (2013.01)

(58) Field of Classification Search

CPC ..... A47L 13/16; A47L 13/24; A47L 13/25; A47L 13/253; A47L 13/46; B25G 3/38; B25G 1/06; A46B 5/002; A46B 5/0021; A46B 5/0062; A46B 5/0075

USPC ..... 15/144.1, 147.1, 150

See application file for complete search history.

(56) References Cited

U.S. PATENT DOCUMENTS

| | | | | |
|---|---|---|---|---|
| 7,958,591 | B1 * | 6/2011 | Rogers | A47L 4/00 15/147.1 |
| 9,119,456 | B1 * | 9/2015 | Hudson | A45D 34/04 |
| 2005/0257345 | A1 * | 11/2005 | Mitchell | A47L 13/20 16/436 |
| 2006/0123575 | A1 * | 6/2006 | Maloney | A47L 13/24 15/144.1 |
| 2007/0089255 | A1 * | 4/2007 | Michelson | A47L 13/12 15/144.3 |
| 2014/0096796 | A1 * | 4/2014 | Frum | A47L 11/1625 134/6 |

* cited by examiner

*Primary Examiner* — Saeed T Chaudhry

(74) *Attorney, Agent, or Firm* — Ruth Eure; Emery L. Tracy

(57) ABSTRACT

A cleaning tool device for cleaning a desired area with a cleaning implement is provided. The cleaning tool device comprises a handle portion having a first end and a second end and a tool portion having a first end and a second end. The first end of the tool portion releasably secured to the second end of the handle portion. A clip mechanism is mounted to the second end of the tool portion for releasably securing the cleaning implement. Upon positioning the cleaning implement in the clip mechanism, a user can manipulate the cleaning implement to clean in hard to reach areas.

20 Claims, 2 Drawing Sheets

CLEANING TOOL DEVICE

The present application claims the benefit of priority of provisional patent application Ser. No. 61/821,190, filed on May 8, 2013, entitled "Cleaning Tool".

BACKGROUND OF THE INVENTION

1. Field of the Invention

This invention relates generally to a cleaning tool device and, more particularly, the invention relates to a cleaning tool device having a lengthy cylinder of hard, injection-molded plastic with a screw-threaded fitting at one end for attaching to additional extensions, and a large, stylized, locking clamp on the other, for securing to sponges and wash cloths, etc.

2. Description of the Prior Art

Keeping a home or place of business clean is an important part of regular maintenance. Unfortunately, it can often be quite difficult to ensure that all the various different locations that require cleaning actually receive it. Getting proper scouring to happen in the most difficult-to-reach places can be incredibly harrowing, especially for cleaners who suffer from arthritis or other mobility-decreasing conditions that stand in the way of regular joint flexibility. Maneuvering a rag or sponge by hand can be quite ineffective in these situations, as it's often quite hard to apply the amount of pressure and force required to truly clean the affected areas.

A proper amount of force applied to one's cleaning device, be it a rag or a sponge, is the only solution to seriously caked-on and dried-up dirt and grime. Serious scrubbing is required, and that can be a considerable hurdle for one with limited elbow mobility to overcome. Mustering the strength and leverage required to effectively remove stains is nearly impossible in hard-to-reach areas, especially when working with cleaning devices that don't have any type of usable handle with which to manipulate them. Pushing hard is required, if one ever hopes to make a dent in regular cleaning tasks, but can be near-impossible with the types of tools traditionally applied to solve these problems. The lack of a useful handle on these types of devices means that harried cleaning staff and homemakers are often forced to stoop and bend considerably, and may even damage their delicate muscles and tendons by contorting into improper positions.

SUMMARY

The present invention is a cleaning tool device for cleaning a desired area with a cleaning implement. The cleaning tool device comprises a handle portion having a first end and a second end and a tool portion having a first end and a second end. The first end of the tool portion releasably secured to the second end of the handle portion. A clip mechanism is mounted to the second end of the tool portion for releasably securing the cleaning implement. Upon positioning the cleaning implement in the clip mechanism, a user can manipulate the cleaning implement to clean in hard to reach areas.

In addition, the present invention includes a cleaning tool device for cleaning a desired area with a cleaning implement. The cleaning tool device comprises a handle portion having a first end and a second end. A flexible joint is formed in the handle portion nearingly adjacent the second end of the handle portion. A tool portion having a first end and a second end is provided with the first end of the tool portion releasably threadably secured to the second end of the handle portion. A clip mechanism is mounted to the second end of the tool portion for releasably securing the cleaning implement. Upon positioning the cleaning implement in the clip mechanism, a user can manipulate the cleaning implement to clean in hard to reach areas.

The present invention further includes a method for cleaning a desired area with a cleaning implement. The method comprises providing a handle portion having a first end and a second end, forming a flexible joint in the handle portion nearingly adjacent the second end of the handle portion, providing a tool portion having a first end and a second end, releasably threading the first end of the tool portion to the second end of the handle portion, mounting a clip mechanism to the second end of the tool portion, releasably securing the cleaning implement within the clip mechanism, and manipulating the cleaning implement to clean in hard to reach areas.

DETAILED DESCRIPTION OF THE PREFERRED EMBODIMENTS

Figure 1:
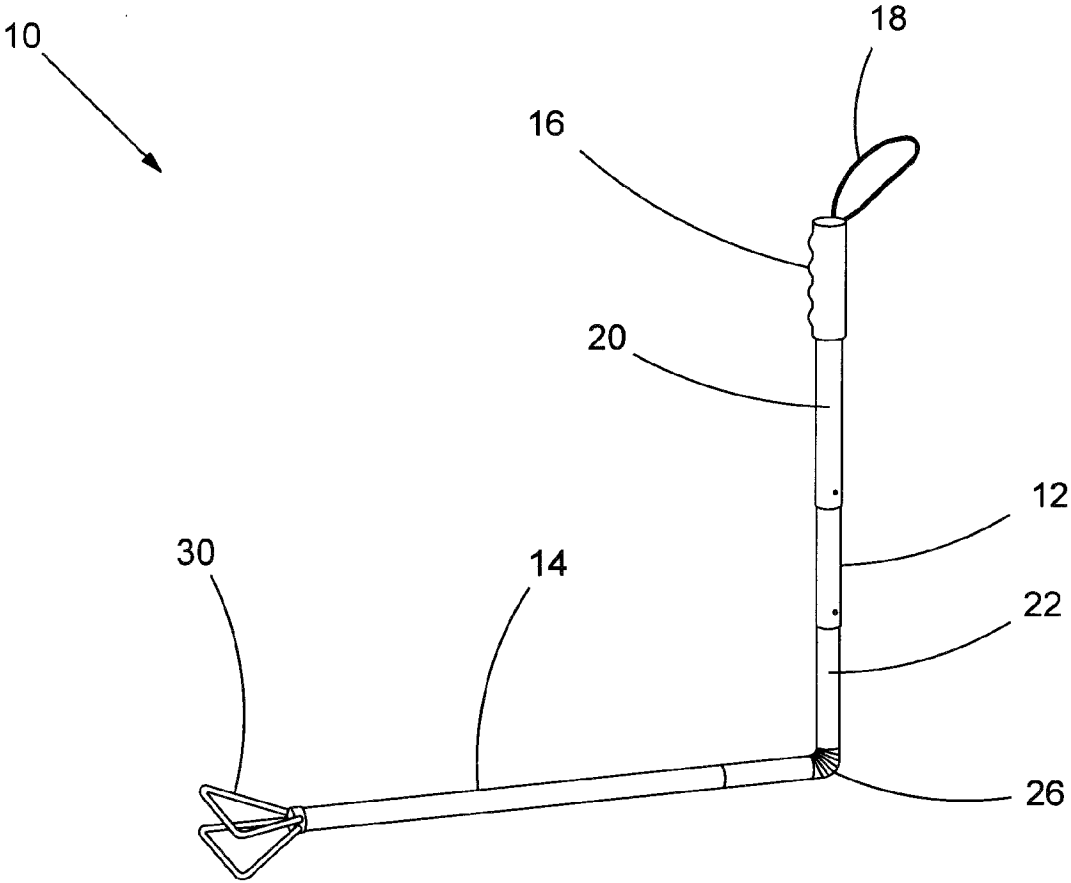
FIG. 1 is a perspective view illustrating a cleaning tool device, constructed in accordance with the present invention.
Figure 3:
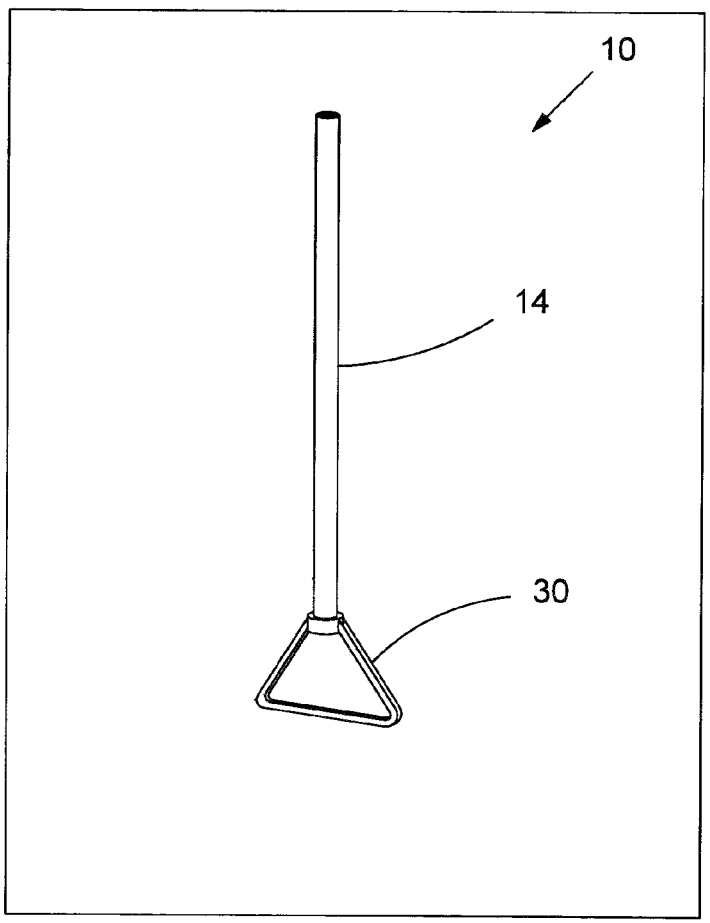
FIG. 3 is a perspective view illustrating a tool portion of the cleaning tool, constructed in accordance with the present invention.
Figure 2:
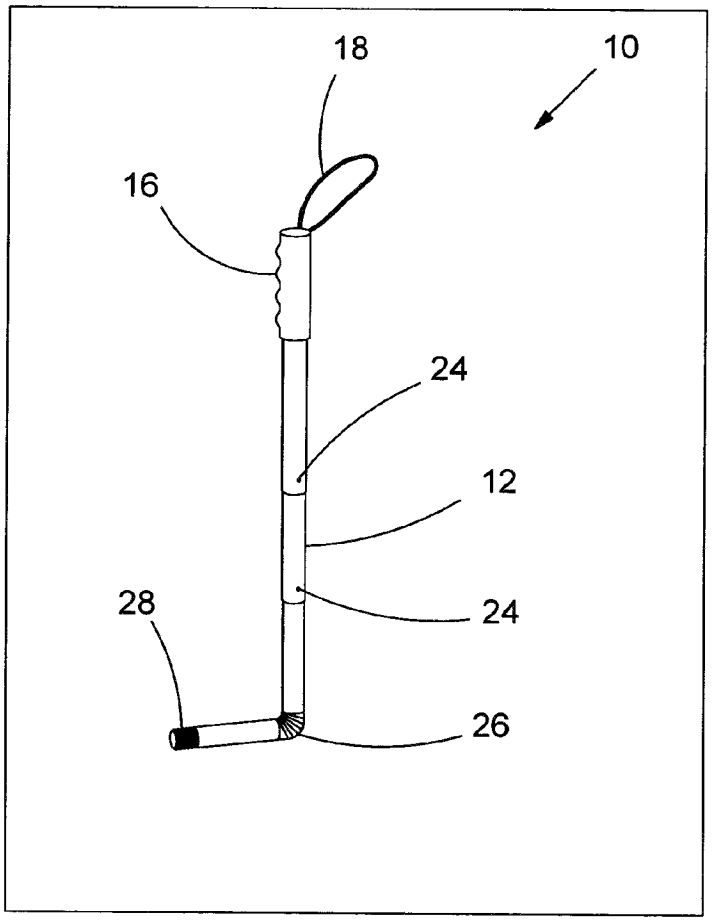
FIG. 2 is a perspective view illustrating a handle portion of the cleaning tool device, constructed in accordance with the present invention.

As illustrated in FIGS. 1-3, the present invention is a cleaning tool device, indicated generally at 10, having a handle portion 12 and a tool portion 14 with the handle portion 12 and the tool portion 14 releasably securable together. The tool portion 14 of the cleaning tool device 10 releasably holds sponges, paper towels, wash cloths, etc. for cleaning a desired area. The cleaning tool device 10 allows a user to clean more areas, faster while reducing undue strain and stress associated with uncomfortable body positioning.

The handle portion 12 of the cleaning tool device 10 of the present invention has a first end and a second end. Attached to the first end of the handle portion 12 is an ergonomic handle 16 providing comfortable grip of the user. A lanyard 18 can extend from the first end of the handle portion 12 allowing the user to hang the cleaning tool device 10 when not in use.

In a preferred embodiment, the length of the handle portion 12 is adjustable allowing a user to adapt the length of the handle portion 12 to a desired position. In this manner, the handle portion 12 has a first handle portion 20 having a first end and a second end and a second handle portion 22 having a first end and a second end. Preferably, the first end of the second handle portion 22 is slidably receivable in the second end of the first handle portion 20. The releasable relative position of the first handle portion 20 to the second handle portion 22 can be maintained by spring loaded buttons 24 formed on the second handle portion 22 of the handle portion 12 releasably receivable in apertures formed in the first handle portion 20 of the handle portion 12 or relative position of the first handle portion 20 of the handle portion 12 to the second handle portion 22 of the handle portion 12 can be maintained by friction or other mechanical means.

In addition, the cleaning tool device 10 of the present invention includes a flexible joint 26 formed in the handle portion 12 nearingly adjacent the second end of the handle portion 12. The flexible joint 26 allows the second end of the handle portion 12 to be angled relative to the remaining portion of the handle portion 12 thereby providing the user the ability to move the second end to any desired angle. The desired position of the second end relative to the remaining portion of the handle portion 12 can be accomplished by friction or mechanical means. A screw-threaded fitting 28 is formed at the second end of the handle portion 12 for releasably attaching the tool portion 14, as will be described in further detail below.

The tool portion 14 of the cleaning tool device 10 of the present invention has a first end and a second end. The first end of the tool portion 14 is threaded to accommodate the threaded fitting 28 on the second end of the handle portion 12 such that the tool portion 14 is releasably securable to the handle portion 12. At the second end of the tool portion 14 is a clip mechanism 30 for holding sponges, paper towels, wash cloths, etc. Preferably, the width of the clip mechanism 30, which holds the choice of cleaning item, is at least four (4") inches wide enabling the user to position the cleaning item to clean more effectively. Once positioned within the clip mechanism 30, the sponges, paper towels, wash cloths, etc. are available for cleaning purposes and easily removed when soiled.

It should be noted that the cleaning tool device 10 of the present invention can also be available in a deluxe model, with a custom, flexible extension handle portion 12, which is capable of being secured to the end of the tool portion 14 in a similar manner.

Preferably, the handle portion 12 and the tool portion 14 of the cleaning tool device 10 of the present invention are constructed from a rigid, injection-molded plastic material although constructing the handle portion 12 and the tool portion 14 from other rigid materials is within the scope of the present invention.

The manner of use of the cleaning tool device 10 of the present invention will now be described. It will be understood by those skilled in the art that the manner of use of the cleaning tool device 10 described herein is merely one method of use and other methods of use of the cleaning tool device 10 are within the scope of the present invention.

Use of the cleaning tool device 10 of the present invention is simple and straightforward. The simplified design of the cleaning tool device 10 ensures that the cleaning tool device 10 can be readily applied in all different situations where users require an extended handle on their cleaning tool devices 10, for increased reach and better leverage. First, the user should decide if they require the regular or deluxe version of the cleaning tool device 10. In situations where the user already has threaded mop or broom handles, the regular version of the cleaning tool device 10 should suffice. Other users will find the deluxe version, with its extended, flexible handle, more appropriate for their needs, allowing them to reach all the different areas of dirt and grime with ease. Once the correct model has been selected and purchased, the cleaning tool device 10 is brought to the user's home or other location which requires cleaning. Once there, the cleaning tool device 10 is removed from its packaging and so made ready for use.

Any regular wash cloth, rag or sponge, etc. can be affixed to the clip mechanism 30 of the tool portion 14 of the cleaning tool device 10 of the present invention. This involves merely opening the clip mechanism 30 at the second end of the tool portion 14. Once the clip mechanism 30 is opened, the cleaning implement of the user's choice can be inserted between its two jaws, and the clip mechanism 30 closed again around the object, securing it in place. After the cleaning implement has been secured, the user determines if the extra extension offered by a mop handle or the deluxe version's included extension handle portion is required for the particular areas being cleaned. If so, these pieces can be attached to the cleaning tool device 10 by screwing them into the threaded fastener at the first end of the tool portion 14. The cleaning tool device 10 can then be used to clean the areas which require cleaning, offering the user both the reach and the leverage required to work in difficult-to-access areas without unnecessary bending or kneeling. Once the cleaning work is concluded, the cleaning implement can be released from the clip of the tool portion and returned to storage until the next round of cleaning begins.

The cleaning tool device 10 of the present invention offers a considerable advantage over regular, hand-held use of various different cleaning devices, including rags, paper towels, cloths and sponges. The cleaning tool device 10 provides a level of extended reach and improved leverage unavailable from any other device on the market. These increased capabilities allow users to clean more areas, faster, and with more professional results, all the while cutting down on undue strain and stress associated with uncomfortable body positioning.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A cleaning tool device for cleaning a desired area with a cleaning implement, the cleaning tool device comprising:

a handle portion having a first end and a second end;

a tool portion having a first end and a second end, the first end of the tool portion releasably secured to the second end of the handle portion; and a clip mechanism mounted to the second end of the tool portion, the clip mechanism being openable for receiving the cleaning implement and closable about the cleaning implement thereby releasably securing the cleaning implement within the clip mechanism;

wherein upon positioning the cleaning implement in the clip mechanism, a user can manipulate the cleaning implement to clean in hard to reach areas.

2. The cleaning tool device of claim 1 wherein the cleaning implement is selected from the group consisting of sponges, paper towels, and wash cloths.

3. The cleaning tool device of claim 1 and further comprising:

an ergonomic handle secured to the first end of the handle portion.

4. The cleaning tool device of claim 1 and further comprising:

a lanyard secured to the first end of the handle portion.

5. The cleaning tool device of claim 1 and further comprising:

a first handle portion having a first end and a second end; and a second handle portion having a first end and a second end;

wherein the first end of the second handle portion is slidably receivable in the second end of the first handle portion.

6. The cleaning tool device of claim 5 and further comprising:

a securing mechanism for securing the first handle portion to the second handle portion.

7. The cleaning tool device of claim 6 wherein the securing mechanism is at least one spring loaded button formed on the second handle portion and at least one corresponding aperture formed in the first handle portion, the at least one spring loaded button receivable within the at least one aperture.

8. The cleaning tool device of claim 1 and further comprising:

a flexible joint formed in the handle portion adjacent the second end of the handle portion.

9. The cleaning tool device of claim 1 wherein the second end of the handle portion is releasably secured to the first end of the tool portion by a threadable connection.

10. A cleaning tool device for cleaning a desired area with a cleaning implement, the cleaning tool device comprising:

a handle portion having a first end and a second end;

a flexible joint formed in the handle portion adjacent the second end of the handle portion;

a tool portion having a first end and a second end, the first end of the tool portion releasably threadably secured to the second end of the handle portion; and a clip mechanism mounted to the second end of the tool portion, the clip mechanism being openable for receiving the cleaning implement and closable about the cleaning implement thereby releasably securing the cleaning implement within the clip mechanism;

wherein upon positioning the cleaning implement in the clip mechanism, a user can manipulate the cleaning implement to clean in hard to reach areas.

11. The cleaning tool device of claim 10 wherein the cleaning implement is selected from the group consisting of sponges, paper towels, and wash cloths.

12. The cleaning tool device of claim 10 and further comprising:

an ergonomic handle secured to the first end of the handle portion.

13. The cleaning tool device of claim 10 and further comprising:

a lanyard secured to the first end of the handle portion.

14. The cleaning tool device of claim 10 and further comprising:

a first handle portion having a first end and a second end; and a second handle portion having a first end and a second end;

wherein the first end of the second handle portion is slidably receivable in the second end of the first handle portion.

15. The cleaning tool device of claim 14 and further comprising:

a securing mechanism for securing the first handle portion to the second handle portion.

16. The cleaning tool device of claim 15 wherein the securing mechanism is at least one spring loaded button formed on the second handle portion and at least one corresponding aperture formed in the first handle portion, the at least one spring loaded button receivable within the at least one aperture.

17. The cleaning tool device of claim 10 wherein the second end of the handle portion is releasably secured to the first end of the tool portion by a threadable connection.

18. A method for cleaning a desired area with a cleaning implement, the method comprising:

providing a handle portion having a first end and a second end;

forming a flexible joint in the handle portion adjacent the second end of the handle portion;

providing a tool portion having a first end and a second end;

releasably threading the first end of the tool portion to the second end of the handle portion;

mounting a clip mechanism to the second end of the tool portion;

opening the clip mechanism;

closing the clip mechanism about the cleaning implement;

releasably securing the cleaning implement within the clip mechanism; and manipulating the cleaning implement to clean in hard to reach areas.

19. The method of claim 18 and further comprising:

providing a first handle portion having a first end and a second end;

providing a second handle portion having a first end and a second end; and slidably inserting the first end of the second handle portion receivable in the second end of the first handle portion.

20. The method of claim 19 and further comprising:

releasably securing the first handle portion to the second handle portion.

* * * * *